US011786020B1

(12) United States Patent
Mata

(10) Patent No.: US 11,786,020 B1
(45) Date of Patent: Oct. 17, 2023

(54) CONVENIENCE TOTE

(71) Applicant: Ely-leen Mata, Mount Pleasant, PA (US)

(72) Inventor: Ely-leen Mata, Mount Pleasant, PA (US)

( * ) Notice: Subject to any disclaimer, the term of this patent is extended or adjusted under 35 U.S.C. 154(b) by 351 days.

(21) Appl. No.: 17/146,302

(22) Filed: Jan. 11, 2021

(51) Int. Cl.

| | |
|---|---|
| ***A45C 3/06*** | (2006.01) |
| ***A44B 19/26*** | (2006.01) |
| ***A45C 3/12*** | (2006.01) |
| ***A45C 1/08*** | (2006.01) |

(52) U.S. Cl.
CPC ..... *A45C 3/06* (2013.01); *A44B 19/26* (2013.01); *A45C 1/08* (2013.01); *A45C 3/12* (2013.01); *A45C 2001/086* (2013.01)

(58) Field of Classification Search
CPC .... A45C 3/06; A45C 3/12; A45C 3/08; A45C 3/02; A45C 3/04; A45C 3/10; A45C 2001/086; A45C 13/02; A45C 13/023; A45C 2013/025; A45F 3/02; A45F 3/04; A45F 2200/0525; A45F 2200/05; A45F 2200/0558
See application file for complete search history.

(56) References Cited

U.S. PATENT DOCUMENTS

| | | | | |
|---|---|---|---|---|
| 2006/0118376 | A1* | 6/2006 | Godshaw | A45C 7/0036 190/115 |
| 2007/0000796 | A1* | 1/2007 | Kameoka | A45C 11/24 206/278 |
| 2009/0039123 | A1* | 2/2009 | Sween | A45C 13/02 29/592 |
| 2011/0284598 | A1* | 11/2011 | Lawson | A45C 11/20 224/153 |
| 2014/0261933 | A1* | 9/2014 | Jones | A45C 13/30 150/108 |
| 2019/0022262 | A1* | 1/2019 | Andrews | A45C 15/00 |

* cited by examiner

*Primary Examiner* — Javier A Pagan
(74) *Attorney, Agent, or Firm* — Richard K Thomson

(57) ABSTRACT

A convenience tote is provided with a plurality of laterally accessible pouches which can remotely retain an umbrella and spare pair of shoes secluded from the contents of the main compartment. Additional compartments can secure a laptop computer, a cell phone, a wallet, and the like.

3 Claims, 6 Drawing Sheets

CONVENIENCE TOTE

BACKGROUND AND SUMMARY OF THE INVENTION

The present invention is directed to the field of luggage. More particularly, the present invention is directed to a utility handbag or convenience tote providing compartmental storage for various and sundried items a professional woman needs to get through her day, having specialized storage for a computer, a phone, a wallet, an umbrella and a spare pair of shoes. This unique luggage item will shortly be available under the name "COMPARTOTE™".

Regardless of the size of her family, there are many items, personal, emotional, and physical, that a professional woman must juggle, each and every day. Add to the mix, inclement weather or difficult travel in high heels, and the physical items can border on overwhelming.

It is one of the objects of the present invention to alleviate some of that burden by providing a convenience tote that includes water-resistant interior pouches for a computer, a phone, a wallet, an umbrella, and a second pair of shoes to allow her to wear weather-resistant/comfortable shoes for traveling to and from work and still have a pair of dressy shoes to change into once she has reached her destination, to compliment her business attire. It will be understood that the shoe pouch can contain dressy shoes for work or evening event, for example, while more practical/comfortable shoes are worn for the transit. The pouches for the umbrella and spare shoes are accessible via external zipper openings and do not communicate with the internal compartment housing the computer and other personal items so residual moisture and soil adhering to the shoes cannot infiltrate/contaminate the region or items. In addition, the tote has internal pockets for a laptop, cell phone, and a secure pocket for a wallet, or the like, so the wallet or other item do not tumble about in the main compartment. The interior of the tote can accommodate a conventional purse, lunch bag/box, and a variety of other items.

The present invention is directed to a convenience tote comprising: a) a first side; b) a second side; c) a bottom, said first side, second side and bottom defining a main compartment; d) a first end having a first opening closed by a first vertically oriented zipper; e) a second end having a second opening closed by a second vertically oriented zipper; f) a first pouch forming a first enclosure with a first open side aligning with the first opening in the first end; g) a second pouch forming a second enclosure with a second open side aligning with the second opening in the second end; whereby the first and second pouches can retain items in the first and second enclosures, respectively, remotely within the main compartment.

The convenience tote of the present invention further includes a first tertiary secluded compartment for securing a laptop computer, or the like. Additional tertiary secluded compartments are included for potentially housing a cell phone, a wallet, and the like.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENTS

Figure 1:
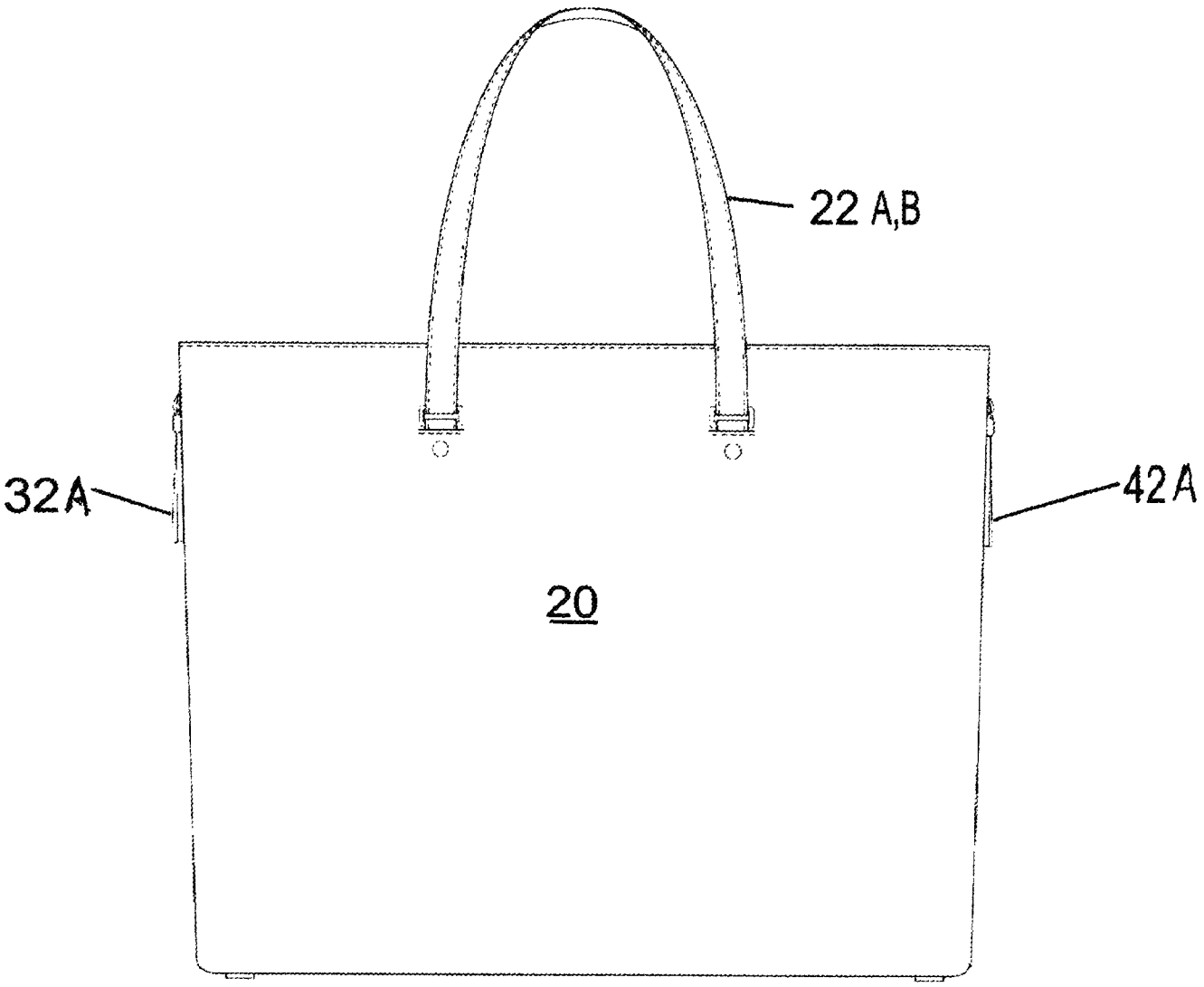
FIG. 1 is a front view of a first embodiment of the convenience tote of the present invention.
Figure 2:
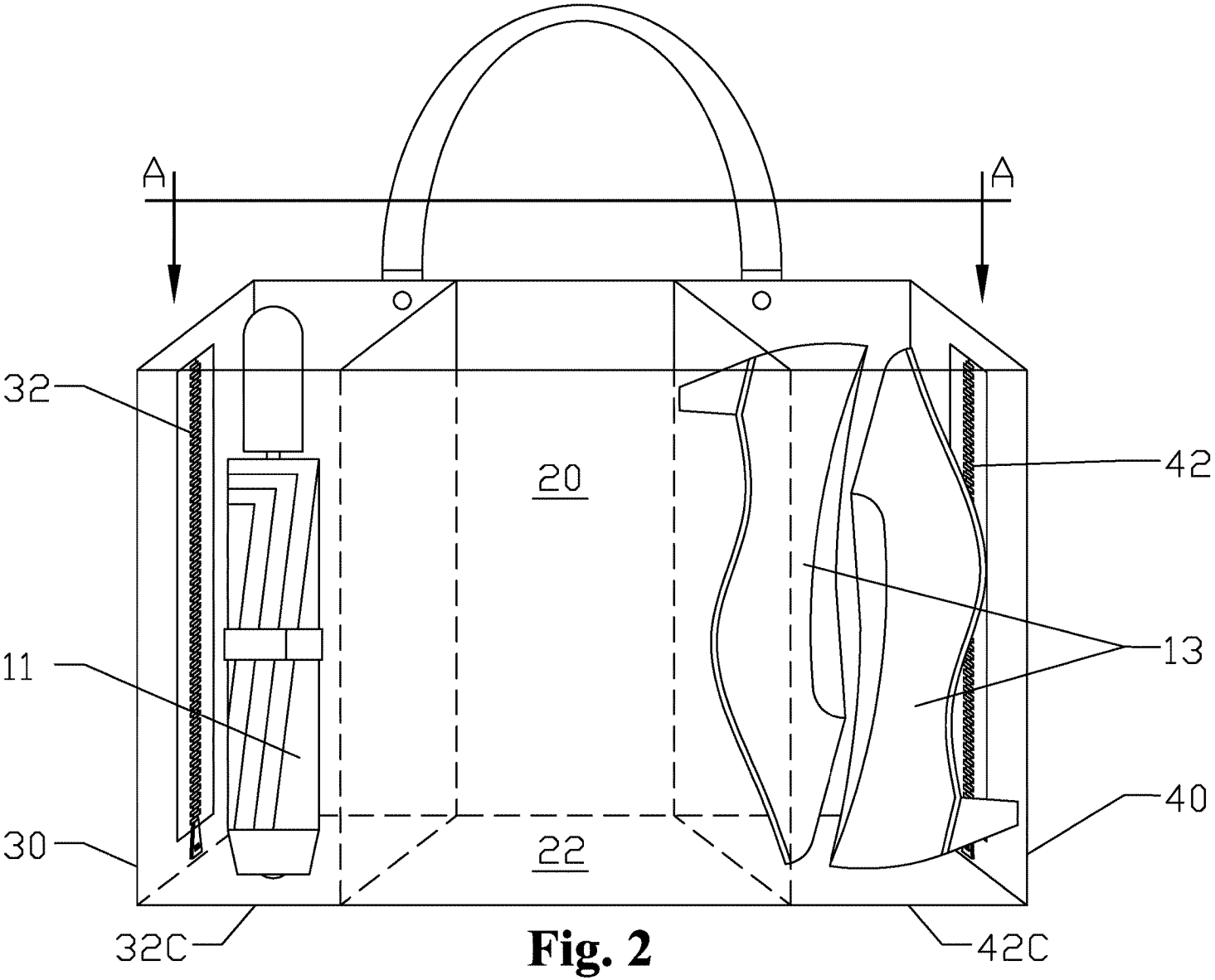
FIG. 2 is a schematic detail of the tote depicted in FIG. 1 with the pouches and their contents ghosted in place.
Figure 3:
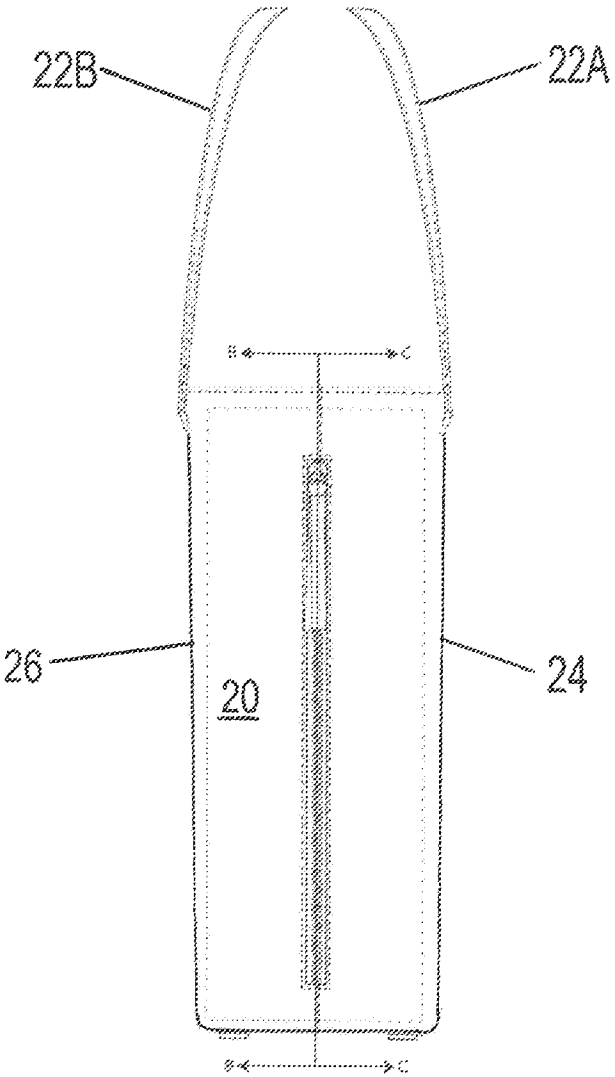
FIG. 3 is an end view of the first embodiment of the convenience tote.
Figure 4:
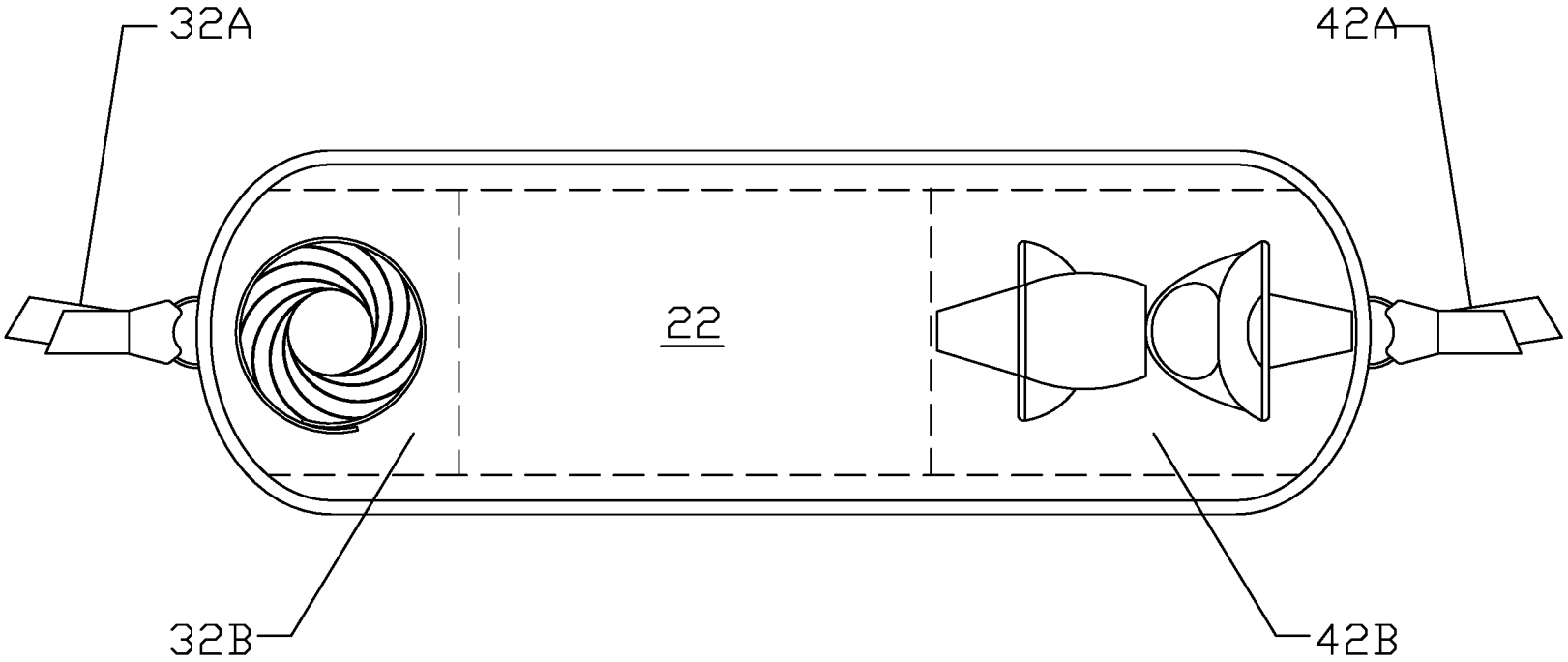
FIG. 4 is a cross-sectional top view taken along line A-A of FIG. 2.

A first embodiment of the convenience tote of the present invention is shown in FIGS. 1, 2, and 3 generally at 20. Tote 20 has a bottom 22 (FIG. 4), a front face 24 with handle 22A attached thereto, a rear face 26 with handle 22B attached thereto (FIG. 3) and is configured with a first entirely enclosed pouch 30 having an open side that aligns with a lateral opening in first end 27, said opening being closed by zipper 32 (FIG. 2). Zipper 32 is operated by pull 32A and is configured to receive an umbrella 11. A second entirely enclosed pouch 40 has an open side that aligns with a lateral opening in second end 28, said lateral opening being closed by zipper 42. Zipper 42 is operated by pull 42A and is configured to receive a pair of shoes 13. Initially, shoes 13 transported in COMPARTOTE™ convenience tote 20 will be those to be worn at the office or special event. After the professional woman arrives at the office, those shoes will be worn and the traveling shoes will be placed in the compartment 40, if they are of a size to fit. In some instances, boots worn in snowy weather will need to remain by her desk until time to return home. Because pouches 30 and 40 are entire enclosures including bottoms 32C and 42C (FIG. 2), as well as tops 32B and 42B (FIG. 4), respectively, the contents of main compartment 70 are protected from moisture and soil/grime which may be associated with the items in secondary compartments formed by pouches 30 and 40. When soft-sided pouches 30 and/or 40 are empty, they are readily collapsed expanding the room available in main compartment 70. Further, soft-sided pouches 30 and/or 40 can be easily inverted, pulled outside the confines of the bag, for cleaning and drying. Compartment 70 provides room for a purse (or the contents normally associated with a purse), keys, a lunch, tissue dispenser, a water bottle or whatever else may be desired.

Figure 5:
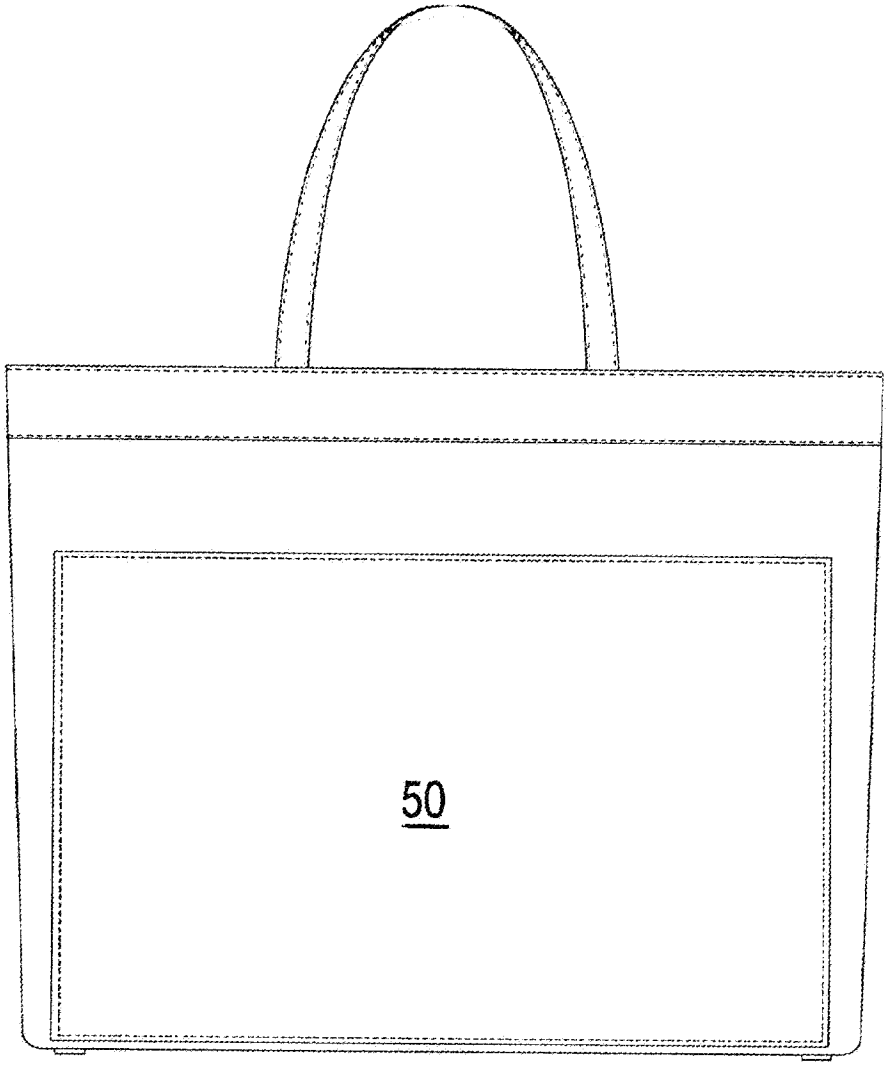
FIG. 5 is a cross-sectional front view taken along lines B-B of FIG. 3; and, FIG. 6 is a cross-sectional rear view as seen along line C-C of FIG. 3.
Figure 6:
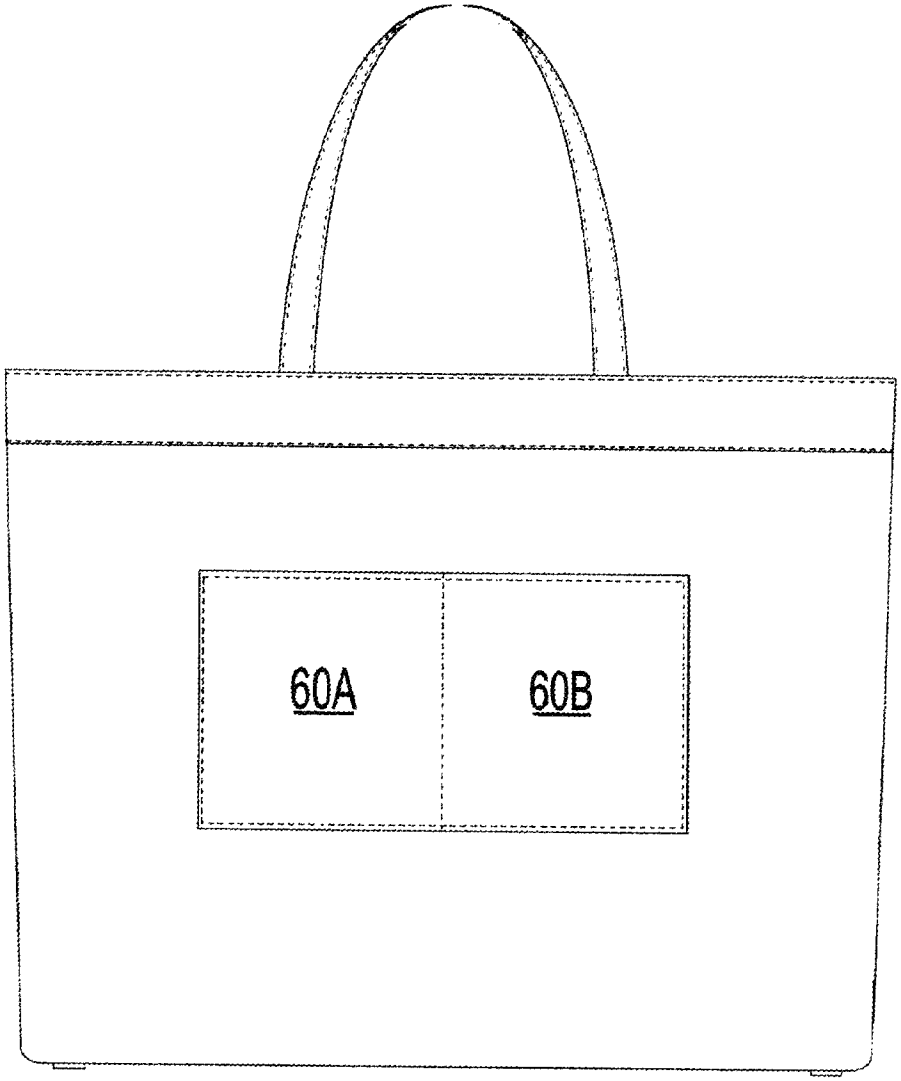

As best seen in FIGS. 5 and 6, the interior of the purse has specialized tertiary compartments 50, 60A, and 60B which can house a laptop computer (in 50) and a cell phone (60A) and wallet (60B), for example. While the edges of compartments 50, 60A, 60B are closed as by stitching, gluing, etc., the tops will be open. Optionally, the tops may be provided with hook-and-loop fasteners, snaps, or the like, to enclose the items providing additional protection.

The utility handbag/convenience tote of the present invention is available from Binibini New York under the name "COMPARTOTE™".

Various changes, alternatives, and modifications will become apparent to a person of ordinary skill in the art after a reading of the foregoing specification. It is intended that all such changes, alternatives, and modifications as fall within the scope of this description be considered part of the present invention.

I claim:

1. A convenience tote comprising:

a) a first side;

b) a second side;

c) a bottom, said first side, second side and bottom defining a main compartment;

d) a first end having a first opening closed by a first vertically oriented zipper;

e) a second end having a second opening closed by a second vertically oriented zipper;

f) a first pouch forming a first enclosure with its own top, bottom, first side, second side and end with a first open side aligning and being coextensive with said first opening in said first end, said first pouch lying within said main compartment;

g) a second pouch forming a second enclosure with its own top, bottom, first side, second side and end with a second open side aligning and being coextensive with said second opening in said second end, said second pouch lying within said main compartment;

whereby said first and second pouches can retain items in said first and second enclosures, respectively, remotely within said main compartment.

2. The convenience tote of claim 1 further comprising a first tertiary secluded compartment for securing a laptop computer.

3. The convenience tote of claim 2 further comprising additional tertiary secluded compartments for housing a cell phone, an umbrella and a wallet.

* * * * *